US006158586A

United States Patent [19]

Müller

[11] Patent Number: 6,158,586

[45] Date of Patent: Dec. 12, 2000

[54] TIGHTENING ARRANGEMENT FOR PAPERBOARD WRAP AND TIGHTENING SECTION FOR APPARATUS FOR APPLYING A WRAP AROUND A PLURALITY OF ARTICLES

[75] Inventor: Rolf Müller, Mehring, Germany

[73] Assignee: Riverwood International Corporation, Atlanta, Ga.

[21] Appl. No.: 09/101,795

[22] PCT Filed: Jan. 17, 1997

[86] PCT No.: PCT/GB97/00123

§ 371 Date: Oct. 2, 1998

§ 102(e) Date: Oct. 2, 1998

[87] PCT Pub. No.: WO97/28059

PCT Pub. Date: Aug. 7, 1997

[30] Foreign Application Priority Data

Jan. 29, 1996 [GB] United Kingdom ..... 9601746

[51] Int. Cl.[7] ..... B65D 65/00

[52] U.S. Cl. ..... 206/427; 206/158; 206/140

[58] Field of Search ..... 206/152, 154, 206/156, 158, 197, 199, 427, 140

[56] References Cited

U.S. PATENT DOCUMENTS

| | | | |
|---|---|---|---|
| 3,045,401 | 7/1962 | Ganz | 53/48 |
| 3,416,654 | 12/1968 | Van Plateringen | 206/197 |
| 4,883,168 | 11/1989 | Dreyfus | 206/154 |
| 5,524,756 | 6/1996 | Sutherland | 206/152 |
| 5,549,197 | 8/1996 | Sutherland | 206/158 |

FOREIGN PATENT DOCUMENTS

| | | | |
|---|---|---|---|
| 0 197 683 A1 | 10/1986 | European Pat. Off. | B65B 21/24 |
| 0 623 511 A1 | 11/1994 | European Pat. Off. | B65B 21/24 |
| 2 584 677 | 1/1987 | France | B65B 49/10 |
| 1 900 393 | 7/1969 | Germany . | |
| 955 623 | 4/1964 | United Kingdom . | |

*Primary Examiner*—David T. Fidei

*Attorney, Agent, or Firm*—Womble Carlyle Sandrige & Rice, PLLC

[57] ABSTRACT

There is provided a tightening arrangement in a paperboard wrap for articles such as bottles 11. In the region of the side/base junction there is provided a number of hinge panels 25 which remain hingedly connected to the wrap. The hinge panels 25 are folded out of alignment with the wrap such that a first part 26 lies in use against the adjacent base panel below a heel part 16 of one of the bottles 11. The hinge connection of the hinge panels 25 provides a firm area for engagement by the substantially straight, continuous edge provided by a series of engaging members 52 mounted on an endless chain.

16 Claims, 9 Drawing Sheets

TIGHTENING ARRANGEMENT FOR PAPERBOARD WRAP AND TIGHTENING SECTION FOR APPARATUS FOR APPLYING A WRAP AROUND A PLURALITY OF ARTICLES

FIELD OF THE INVENTION

The invention relates to paperboard wraps for retaining a number of articles.

SUMMARY OF THE INVENTION

According to one aspect of the present invention there is provided a paperboard wrap comprising two panels hingedly connected together along a fold line and at least one tightening arrangement, each comprising a first cut being made in one panel which first cut has two ends which are both located at a hinge line to define a first part and a second cut being made in the second panel which second cut has two ends which are both located at the hinge line to define a tab part which is integrally formed with the first part to constitute a hinge panel at least one of the ends of the second cut is disposed generally between the two ends of the first cut, whereby in use the hinge panel is pivotted about the hinge line and the parts of the hinge line between adjacent ends of the cuts provide surfaces for engagement with a tightening edge of a packing machine.

Preferably both ends of the second cut are disposed between the ends of the first cut and also the hinge line does not extend across the hinge panel.

In preferred embodiments, the wrap comprises a sleeve for retaining a plurality of articles as a multipack. Conveniently, one panel is a side wall of the sleeve and the other side wall of the sleeve is also constituted by a similar panel. Each side wall may comprise a main side panel and a sub-panel adjacent the second panel.

Generally, the second panel is a base wall of the sleeve and another base wall of the sleeve is also constituted by a similar panel. A further preferred feature is that each pair of first and second cuts constitutes an article retaining seat in use. A further feature of such an arrangement is that when the hinge panel is rotated about the hinge line, the first part lies against the associated base wall and constitutes a seat for an article.

Preferably each article is associated with a hinge panel, the first cut of which is generally C-shaped and the second cut is angled inwardly from both ends and joined with a straight central section which is generally parallel to the hinge line. The first part of the hinge panel need not extend to the first cut in chosen locations such as that part remote from the two ends of the cut.

The two base panels may be connected together using adhesive or interlocking panels or other means.

In some embodiments the hinge line is an extension of said fold line whereas in other embodiments the hinge line is substantially parallel to but spaced from the fold line, with the ends of the first cut extending into the second panel.

According to a second aspect of the present invention there is provided a tightening section for an apparatus for applying a paperboard wrap around a plurality of articles, said tightening section comprising an endless drive member having at least one straight line section and having a multitude of elements which project outwardly from the drive member, elements a number of the elements form a substantially straight edge in said straight line section which edge is substantially parallel to the path of articles through the tightening section and to the path of the drive member in the straight line section.

Preferably, the substantially straight edge is substantially continuous. The elements may be in the form of plates attached to the drive member and also the drive member may be in the form of an endless chain comprising links each having two pivot points by which the link is connected to a further pair of links.

In a preferred arrangement each plate is pivotally attached to two successive pivot points provided by adjacent links, all pivot points of the links being coupled to a plate. Conveniently the chain is constrained for guided movement within guide members at least in certain areas of its endless path.

A further preferred feature is that upstream of the straight line section is a second straight line section which is angled relative to the first straight line section, whereby in use the projecting elements begin to engage respective formations on the paperboard wrap as the wrap passes said second straight line.

According to a third aspect of the present invention there is provided, in combination, a pair of tightening sections spaced apart one on each side of the article path, the straight line sections being located directly opposite each other.

Embodiments of the present invention will now be described in more detail with reference to the accompanying diagrammatic drawings.

DETAILED DESCRIPTION

Figure 1:
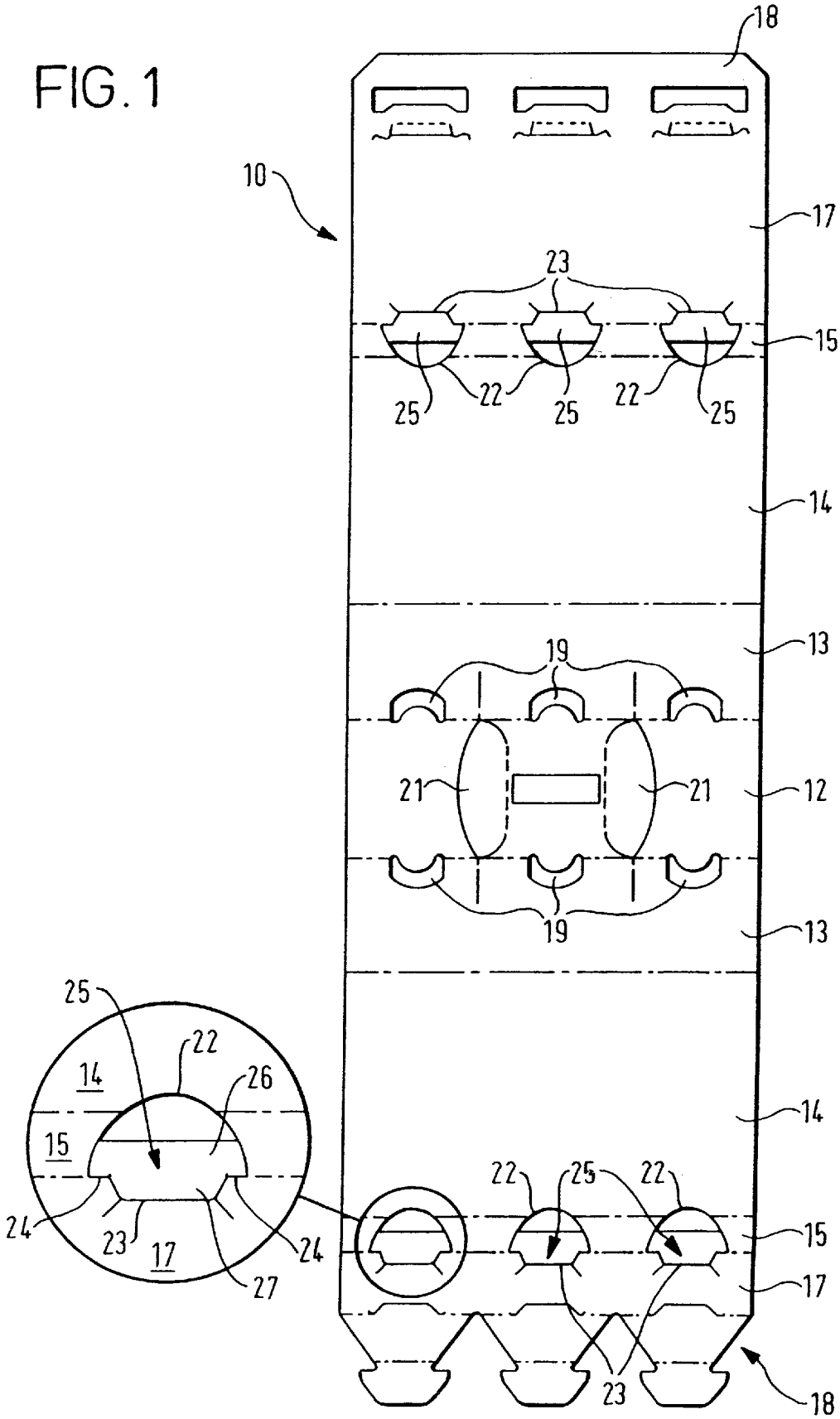
FIG. 1 is a plan view of the present invention, together with an enlarged detail view of a portion of the blank.

FIGS. 1 to 6 show a paperboard blank 10 for forming into a wrap around six bottles 11 arranged in two rows of three. The blank 10 has a top panel 12 hingedly connected to two angled side panels 13 which in turn are hingedly connected to two main side panels 14. At the lower ends of the side panels 14 are lower side panels 15 for receiving heel portions 16 of the bottles 11. Hingedly connected to the lower side panels 15 are base panels 17 which incorporate formations 18 which interlock to close the blank 10 around the six bottles 11. The blank 10 also has top openings 19 for receiving the tops 20 of the bottles 11 and finger holes 21 in the top panel 12 to enable the pack to be easily carried.

With the type of blank shown, and indeed many other types of blank, the blank has to be tightened around the articles being held before and during the securing together of the ends of the blank by interlocking formations or other suitable means such as adhesive. In the heel receiving areas of the blank 10, heel receiving apertures are provided. Each heel receiving aperture is formed primarily by two cuts 22, 23. The first cut 22 is generally arcuate, starting and finishing on the hinge line between the lower side panel 15 and its associated base panel 17. The second cut 23 also starts and finishes on the hinge line between the lower side panel 15 and its base panel 17, but within the ends of the first cut.

The two cuts 22, 23 define, with the hinge portions 24 between the ends of the cuts a hinge panel 25 having a first part 26 defined by the first cut 22 and a tab part 27 adjacent the second cut 23. The hinge between the lower side panel 15 and its base panel 17 does not extend across the hinge panel 25.

It will be appreciated that six such hinge panels 25 are provided on the blank 10 but the number will vary depending on the intended number and arrangement of the articles.

Figures 2, 12:
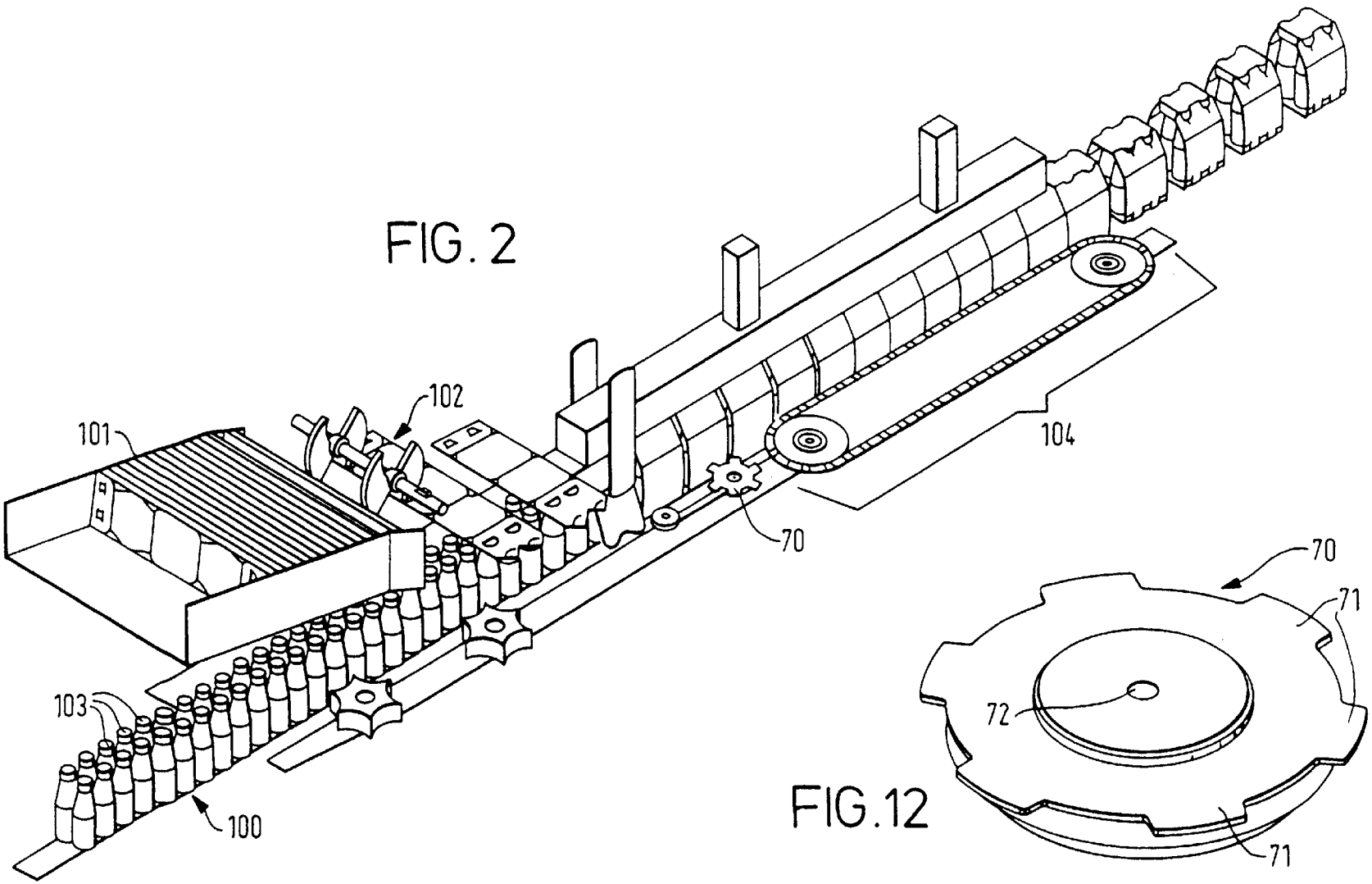
FIG. 2 is a perspective view of a paperboard wrapping apparatus.
FIG. 12 is a perspective view of a rotating disc used in the tightening section.
Figure 3:
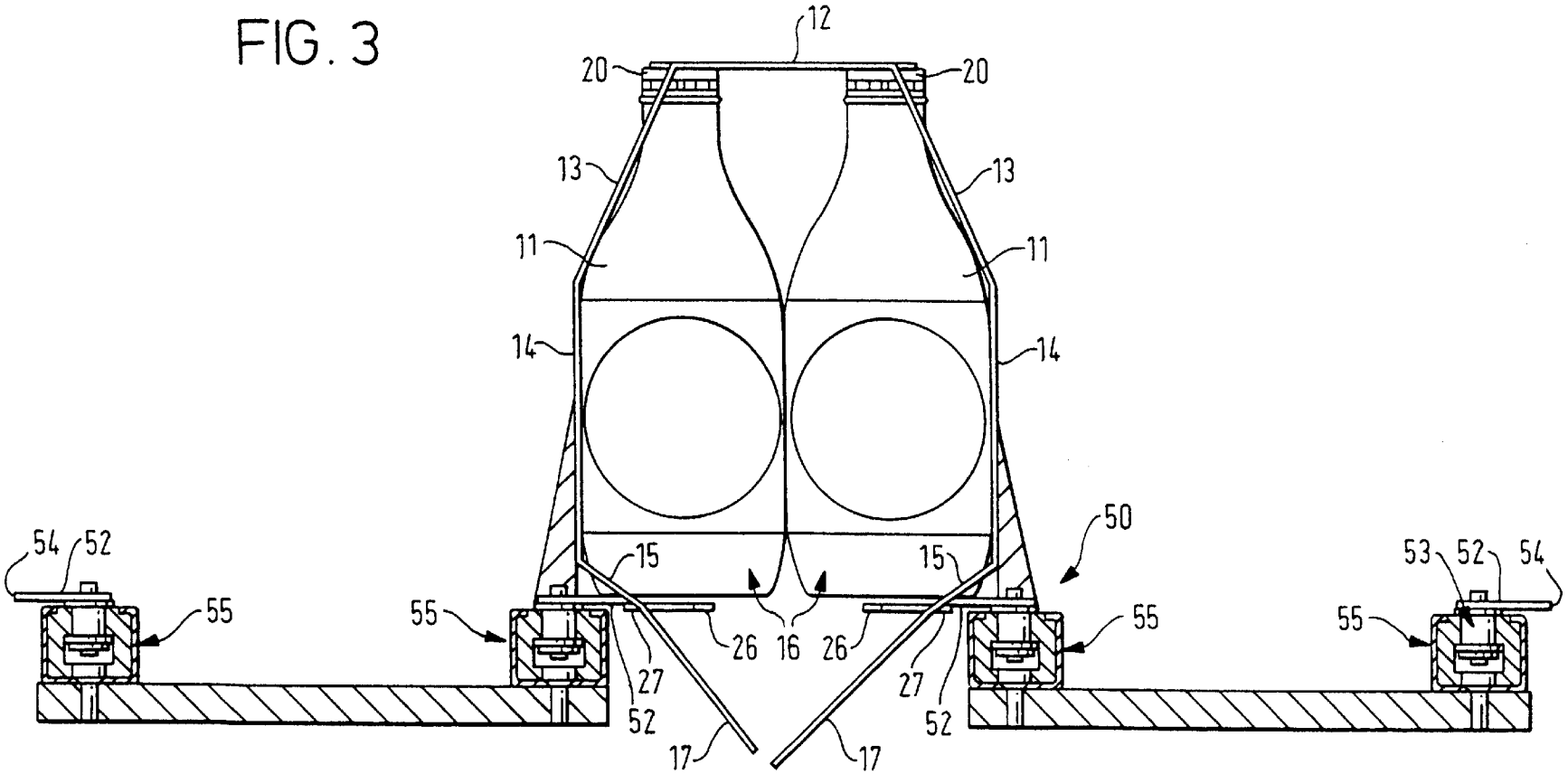
FIG. 3 is a sectional view through tightening apparatus operating on the blank of FIG. 1.
Figure 4:
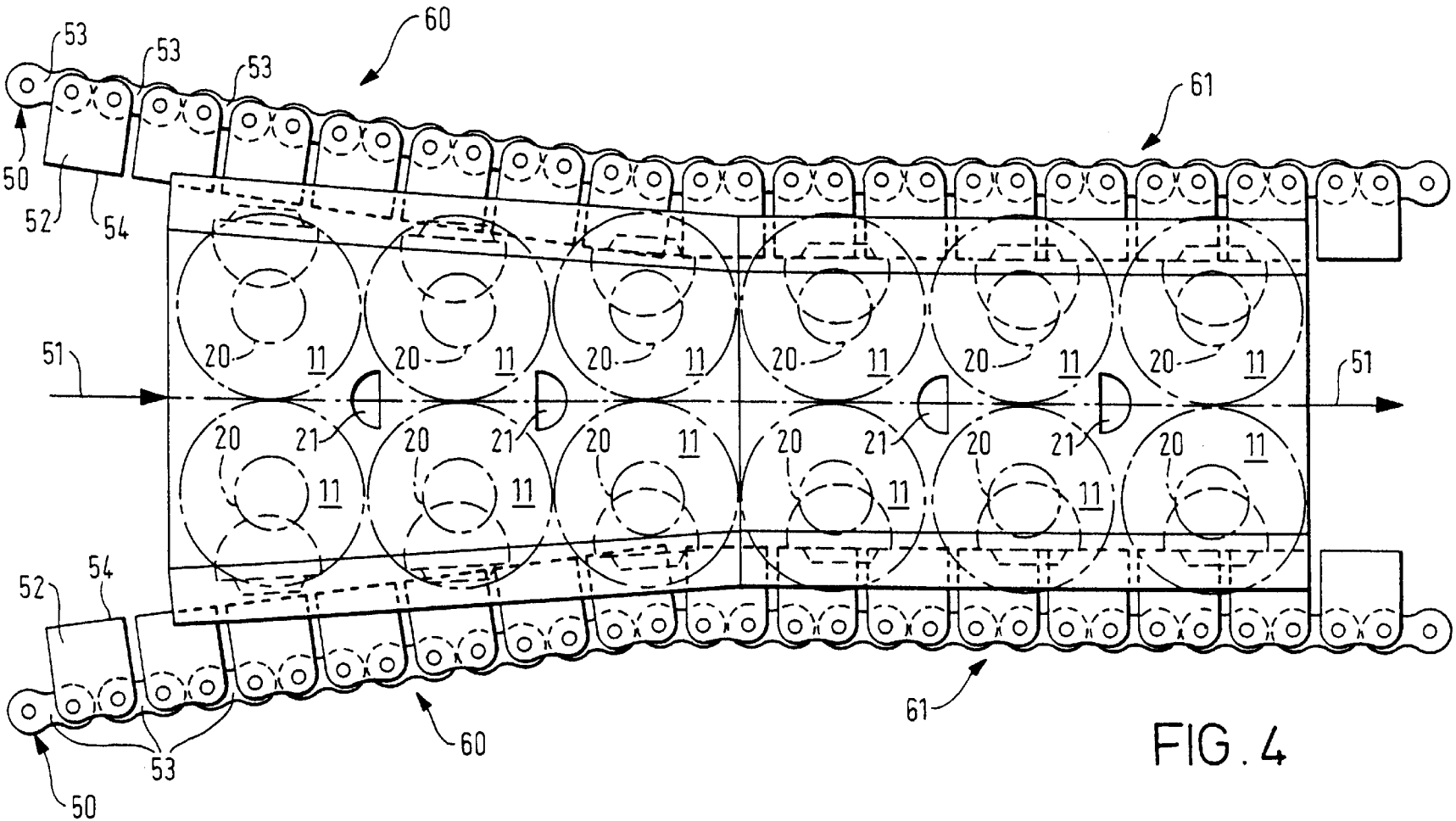
FIG. 4 is a schematic plan view of the apparatus of FIG. 3.
Figure 5:
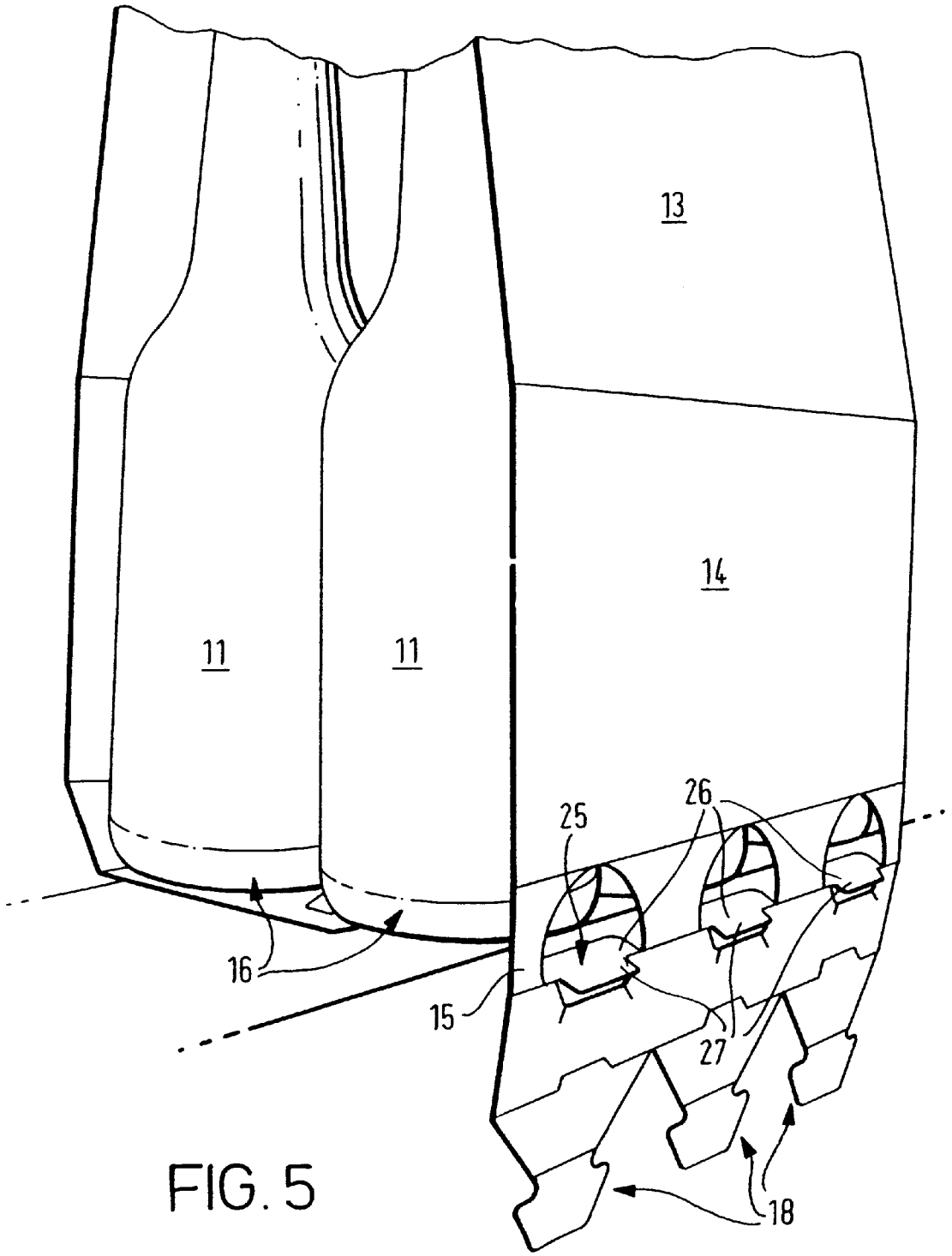
FIG. 5 is a schematic perspective view of a part of the blank folding process.
Figure 6:
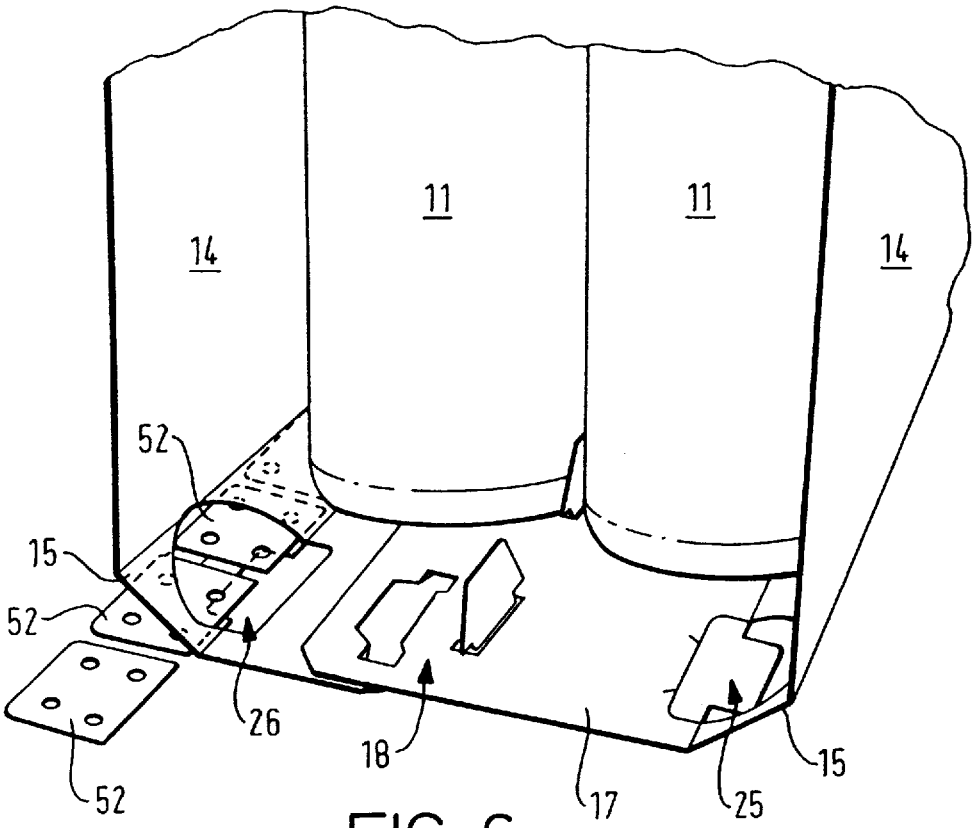
FIG. 6 is a schematic perspective view of part of the assembled blank with two bottles removed, and showing part of the tightening apparatus on one side.

When applying the blank 10 around the bottles 11, conventional paperboard wrapping equipment can be used as illustrated in FIG. 2 which shows a product metering section 100, a magazine 101 for a number of blanks 10, a pick device 102 for picking a blank from the magazine 101 and placing it on the next group of articles which are bottles 103 in this illustrated arrangement. The side panels 14 are then swept down towards the sides of the bottles. The blanks are then folded around the cans and are then tightened and secured in the tightening section 104.

Figure 10:
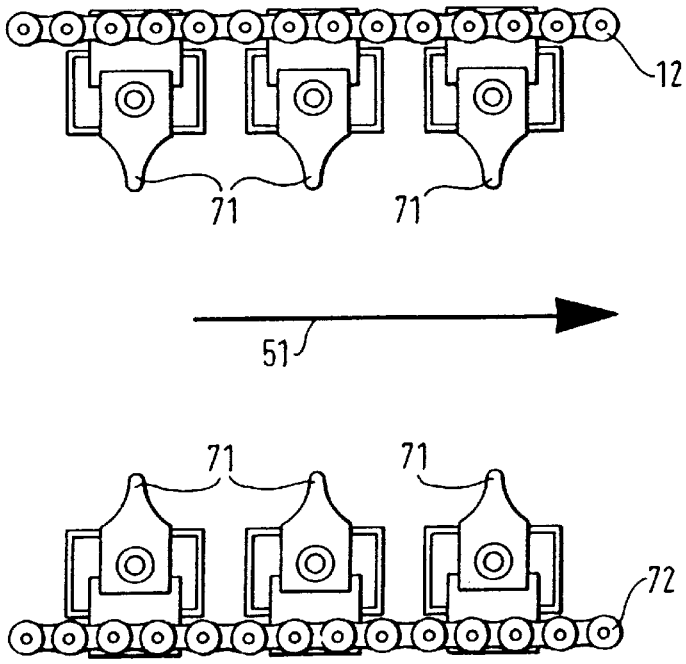
FIG. 10 is a plan view of part of a prior art tightening section.

At present a typical tightening section would be pitched and comprise a number of small fingers 71 mounted in groups at regular spaced intervals on a pair of oppositely side running chains 72. A part of such a tightening section is shown in FIG. 10. These fingers engage in small cut outs in the side panels of the blanks adjacent the base panels. The relationship between the fingers and the cut outs is critical and requires accurate setting. If a different product is to be used on the wrapping machine, it is quite often the case that the positions of the fingers needs to be changed. This is very time consuming and results in increased costs and reduced production.

Just prior to the tightening section of the present arrangement, there is a rotating disc 70 provided on each side of the apparatus. One of these discs 70 is visible in FIG. 2 and is mounted for rotation in a generally horizontal plane about central axis 72. Each disc 70 has a number of lugs 71 which engage the successive first parts 26 of the hinge panels 25 and move them inwardly whilst the tab parts 27 move outwardly thereby to cooperate with the tightening section 104.

The discs may be coated with a suitable friction reducing material and the form of the lugs may vary depending on the form of the hinge panels 25.

Figure 11:
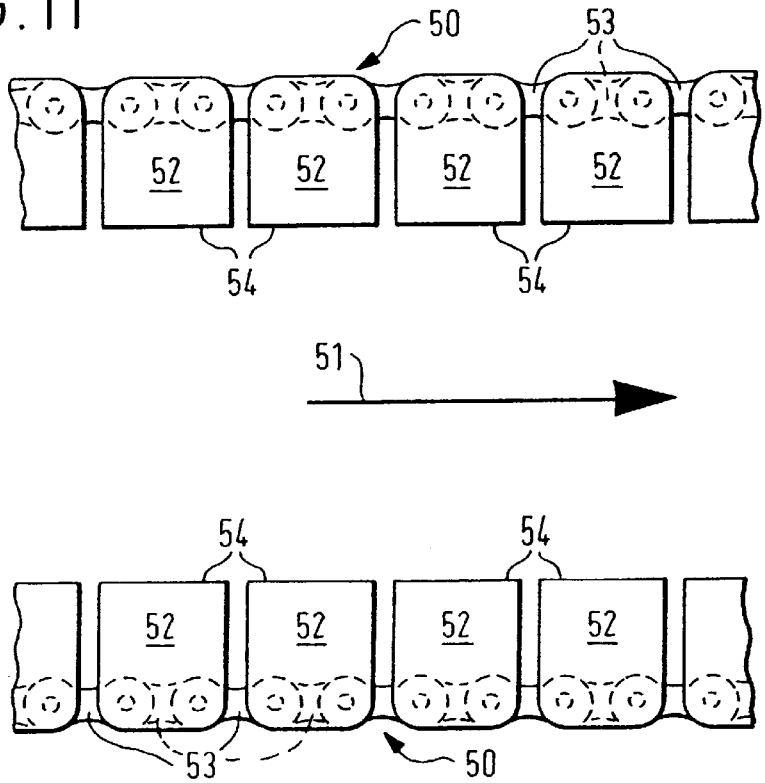
FIG. 11 is a plan view of part of a tightening section according to the present invention.

In the present embodiment, the tightening section includes a pair of oppositely disposed, endless chains 50 which approach the bottles 11 in an angled section 60 as they pass along a conveyor in direction 51, the chains continuing in a straight section 61. Attached to the chains 50 are carton engaging members 52 in the form of substantially flat plates. Each pair of adjacent links 53 of the chain 50 have attached to them, in a pivotal fashion on the pivots of the links, an engaging member 52. Each member 52 has a straight active edge 54 which remains generally parallel to the direction of movement of the chain 50 as it passes adjacent the conveyor in straight section 61. The chains 50 are retained in guides 55 which ensure the accurate passage of the chains 50 in the angled and straight sections 60, 61 alongside the conveyor. When the chains are travelling in straight lines, as illustrated in FIG. 11, it will be seen that the edges 54 provide a combined active edge which is substantially straight and continuous in that it is broken only by small gaps. In practice, these gaps can be negligible if the engaging members 52 are dimensioned accurately.

The generally continuous nature of the active edges 54 of the engaging members 52 enables such equipment to be used on unpitched packaging lines as well as pitched ones.

In use, the blank 10 is placed by the pick device 102 over the bottles 11 as they move along the conveyor. Guide means fold down the side panels 13, 14 and also guide inwardly the lower side panels 15 and the base panels 17. The rotating discs 70 push the first part 26 of the hinge panels 25 inwardly and this enables the first parts 26 to be folded under the bottles 11 and the tightening section 104 to cooperate with the tab part 27 of the hinge panel 25. The blank is then guided such that the hinge portions 24 are engaged by the active edges 54 of the carton engaging members 52. This position is shown clearly in FIG. 3.

As the bottles and blank move further along the conveyor, the blank is tightened around the bottles because the distance between the opposite active edges 54 reduces due to the angled sections 60. In the straight section 61, the active edges 54 press tightly against the fold line 24 on the lower side panel 15 until the base panels 17 are secured together. The tightening process in this arrangement can be particularly strong because the active edges 54 operate on a section of the blank which is effectively of double thickness during the tightening process. This double thickness is a result of the first part 26 of the hinge panel 25 lying against the base panel 17.

When the blank 10 is secured around the bottles 11 it will be appreciated that the first parts 26 of the hinge panel 25 also result in a double layer of board for cushioning the bottom of the bottles. Normally, the outer side of the bottle bottoms will rest on a single thickness of paperboard. In addition, the tab parts 27 can protect the exposed bottle bottom from accidental damage. A better view of the base area of the finished wrap is clearly shown in FIG. 6.

It is not, however, necessary that the first part 26 of the hinge panel 25 extends all the way to the first cut 22. The first part 26 could in fact be truncated so that in the initial blank 10 an aperture is already visible. It is, however, essential that some of the first part 26 remains, especially in the area adjacent the hinge portions 24.

Figure 9:
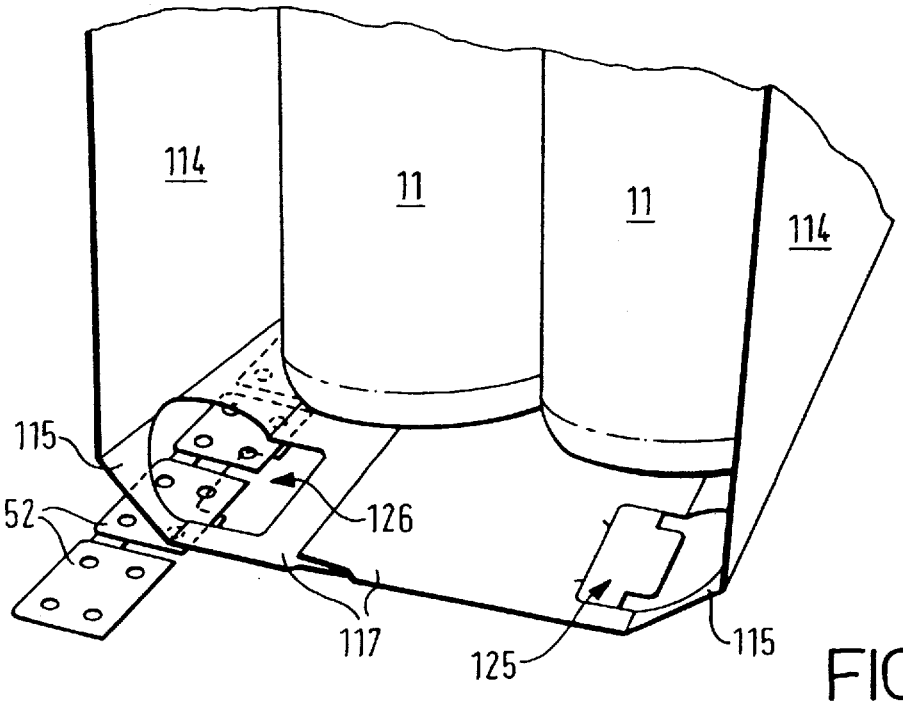
FIG. 9 is a schematic perspective view similar to FIG. 6 of part of the assembled blank of FIG. 7 with two bottles removed.
Figure 7:
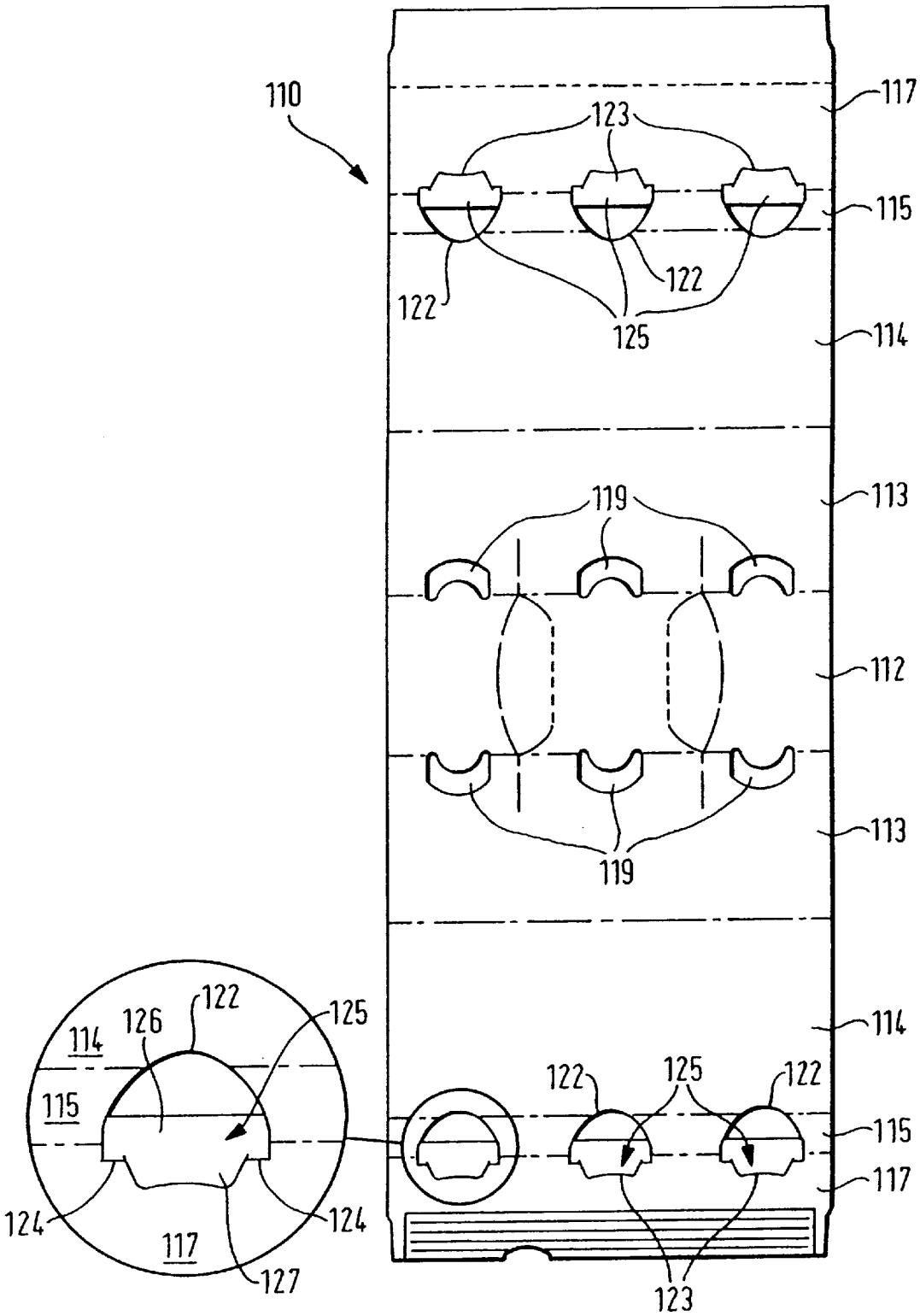
FIG. 7 is a plan view an additional embodiment of the blank according to the present invention, together with an enlarged detail view of a portion of the blank.
Figure 8:
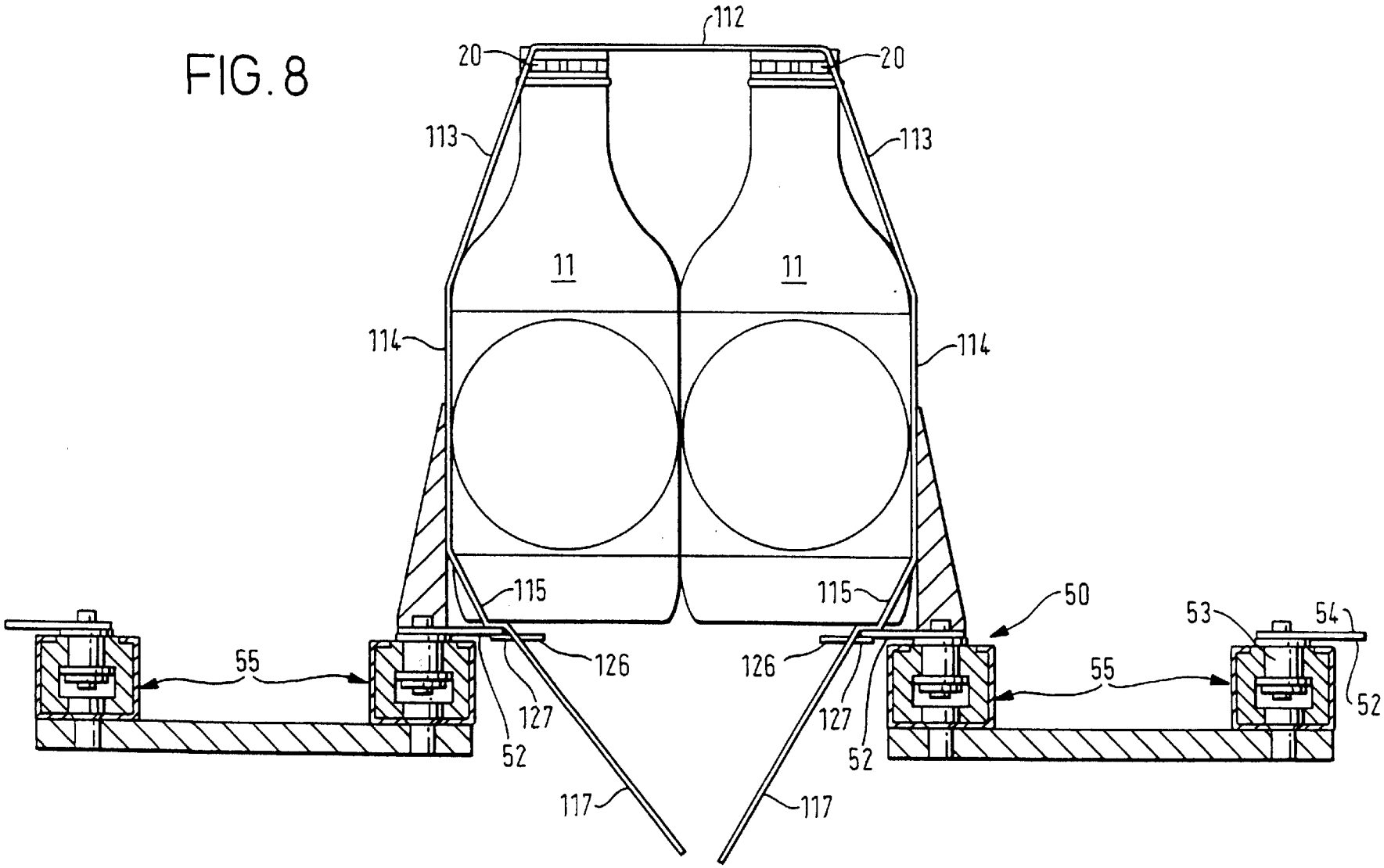
FIG. 8 is a sectional view through tightening apparatus operating on the blank of FIG. 7.

In FIGS. 7 to 9 there is shown an additional embodiment of a blank 110 and its application to six bottles 11. Parts of the blank 10 which are similar to the blank 10 have been given similar numbers prefixed with an additional 1. The principal difference between the two blanks 10, 110 is that in blank 10 the hinge portions 24 about which the hinge panel rotates coincide with the fold between the lower side panel 15 and its associated base panel 17. In blank 110 this is not the case, with the hinge portions 124 being parallel to the fold lines between the lower side panels 115 and the associated base panels 117, but being located in the base panels 117 themselves.

The principal reason for this is the desire to minimise size changing requirements in the tightening section 104 of a wrapping apparatus. The spacing of the hinge portions 124 relative to the base fold lines can be varied dependent on the container diameter and its heel profile which may result in a variety of angles of the lower side panels 15, 115 relative to the base panels and side panels.

The action of the tightening mechanism 104 on a blank 110 having a spacing between the hinges is almost identical as for the coinciding folds except that the plate-like carton engaging members 52 having portions adjacent the active edges 54 which are located directly below the base panels 117 in the straight section 61. This, coupled with other portions adjacent the active edges 54 being located directly above the tab parts 127 improves the location of the active edge against the hinge portions 124 during tightening.

It will be appreciated that the principle described above can be applied to any blank for wrapping a plurality of articles, such as bottles or cans, in a great variety of arrays such as single or double row. Also, the base panels may be secured together by interlocking formations, adhesive or any other suitable method. Although the carton engaging members 52 are shown attached to chains 50, other suitable transport means are possible. Also the size and profile of the members 52 may alter depending on the profile of the product being wrapped.

In other embodiments the angled section 60 could in fact be slightly curved.

While preferred embodiments of the invention have been disclosed in the foregoing specification, it will be understood by those skilled in the art that variations and modifications can be made thereto without departing from the spirit and scope of the invention as set forth in the following claims.

What is claimed is:

1. A paperboard wrap comprising series of panels hingedly connected together along a fold line and at least one tightening arrangement, including a first cut formed in a first panel, which first cut has two ends located along a hinge line to define a first part, and a second cut formed in a second panel, which second cut has two ends located along the hinge line to define a tab part which is integrally formed with the first part to constitute a hinge panel, at least one of the ends of the second cut being disposed generally between the ends of the first cut, whereby in use the hinge panel is pivoted along the hinge line and wherein the hinge panel is limited in motion to rotation about the hinge line, with parts of the hinge line between adjacent ends of the cuts providing surfaces for engagement by a tightening edge of a packing machine.

2. A paperboard wrap as claimed in claim 1 wherein the ends of the second cut are disposed between the ends of the first cut and the hinge line does not extend across the hinge panel.

3. A paperboard wrap as claimed in claim 1 wherein the paperboard wrap comprises a sleeve for retaining a plurality of articles as a multipack.

4. A paperboard wrap as claimed in claim 3 wherein the sleeve includes first and second side walls, and wherein the first panel forms the first side wall of the sleeve, and wherein a third panel similar to the first panel forms the second side wall.

5. A paperboard wrap as claimed in claim 4 wherein each side wall comprises a main side panel and a sub-panel.

6. A paperboard wrap as claimed in claim 1 wherein the second panel comprises a base wall of the sleeve, with another base wall of the sleeve forming a panel similar to the second panel.

7. A paperboard wrap as claimed in claim 1 wherein the first and second cuts form an article retaining seat.

8. A paperboard wrap as claimed in claim 1 wherein as the hinge panel is rotated about the hinge line, the first part is moved adjacent an associated base wall to form a seat for an article.

9. A paperboard wrap as claimed in claim 8 wherein each article is associated with a hinge panel, and the first cut is generally C-shaped and the second cut angled inwardly and joined with a straight central section which is generally parallel to the hinge line.

10. A paperboard wrap as claimed in claim 6 wherein the base panels are connected together with an adhesive.

11. A paperboard wrap as claimed in claim 1 wherein the hinge line is an extension of the fold line.

12. A paperboard wrap as claimed in claim 5 wherein the hinge line is substantially parallel to and spaced from a fold line between the main side panels and sub-panel of the side wall.

13. A paperboard wrap comprising series of panels hingedly connected together along a fold line and at least one tightening arrangement, including a first cut formed in a first panel, which first cut has two ends located along a hinge line to define a first part, and a second cut formed in a second panel, which second cut has two ends located along the hinge line to define a tab part which is integrally formed with the first part to constitute a hinge panel, at least one of the ends of the second cut being disposed generally between the ends of the first cut, whereby in use the hinge panel is pivoted along the hinge line, with parts of the hinge line between adjacent ends of the cuts providing surfaces for engagement by a tightening edge of a packing machine, and wherein the second panel comprises a base wall of the sleeve, with another base wall of the sleeve forming a panel similar to the second panel.

14. A paperboard wrap as claimed in claim 13 wherein as the hinge panel is rotated about the hinge line, the first part is moved adjacent an associated base wall to form a seat for an article, wherein each article is associated with a hinge panel, the first cut is generally C-shaped, and the second cut is angled inwardly and joined with a straight central section which is generally parallel to the hinge line.

15. A paperboard wrap comprising series of panels hingedly connected together along a fold line and at least one tightening arrangement, including a first cut formed in a first panel, which first cut has two ends located along a hinge line to define a first part, and a second cut formed in a second panel, which second cut has two ends located along the hinge line to define a tab part which is integrally formed with the first part to constitute a hinge panel, at least one of the ends of the second cut being disposed generally between the ends of the first cut, whereby in use the hinge panel is pivoted along the hinge line and wherein the hinge panel is limited in motion to rotation about the hinge line, with parts of the hinge line between adjacent ends of the cuts providing surfaces for engagement by a tightening edge of a packing machine, wherein the base panels are connected together with an adhesive.

16. A paperboard wrap comprising series of panels hingedly connected together along a fold line and at least one tightening arrangement, including a first cut formed in a first panel, which first cut has two ends located along a hinge line to define a first part, and a second cut formed in a second panel, which second cut has two ends located along the hinge line to define a tab part which is integrally formed with the first part to constitute a hinge panel, at least one of the ends of the second cut being disposed generally between the ends of the first cut, whereby in use the hinge panel is pivoted along the hinge line and wherein the hinge panel is limited in motion to rotation about the hinge line, with parts of the hinge line between adjacent ends of the cuts providing surfaces for engagement by a tightening edge of a packing machine, wherein the hinge line is substantially parallel to but spaced from the fold line, with the ends of the first cut extending into the second panel.

* * * * *